US005352084A

United States Patent [19]

Hodgins

[11] Patent Number: 5,352,084

[45] Date of Patent: Oct. 4, 1994

[54] REFUSE CARRIER FOR RECYCLABLE AND NON-RECYCLABLE MATERIAL

[76] Inventor: Burt E. Hodgins, R.R. #2, Kincardine, Ontario, Canada, N2Z 2X4

[21] Appl. No.: 840,558

[22] Filed: Feb. 25, 1992

[30] Foreign Application Priority Data

Mar. 4, 1991 [CA] Canada ..... 2037513

[51] Int. Cl.[5] ..... B65F 3/20

[52] U.S. Cl. ..... 414/517; 100/250; 100/271; 414/525.6

[58] Field of Search ..... 414/406–409, 414/509–517, 525.2, 525.3, 525.6; 100/100, 249, 250, 271; 298/8 R

[56] References Cited

U.S. PATENT DOCUMENTS

| | | | |
|---|---|---|---|
| 2,750,055 | 6/1956 | Huffines | 414/525.6 X |
| 3,750,813 | 8/1973 | Fishburne | 414/525.6 X |
| 3,757,969 | 9/1973 | Smith | 414/525.6 X |
| 3,966,096 | 6/1976 | Worthington | 414/517 X |
| 4,050,594 | 9/1977 | Gollnick | 414/517 |
| 4,057,154 | 11/1977 | Neufeldt | 414/525.2 |
| 4,092,051 | 5/1978 | D'Orazio | 298/24 |
| 4,113,120 | 9/1978 | Pickrell | 414/406 X |
| 4,273,497 | 6/1981 | Mealing et al. | 414/517 |
| 4,396,342 | 8/1983 | Henderson | 414/517 X |
| 4,830,436 | 5/1989 | Sockwell et al. | 298/8 R |
| 4,877,366 | 10/1989 | De Filippi | 414/517 |
| 4,979,866 | 12/1990 | Croy | 414/517 |
| 5,123,801 | 6/1992 | O'Daniel | 414/517 X |

FOREIGN PATENT DOCUMENTS

| | | |
|---|---|---|
| 530976 | 9/1956 | Canada . |
| 675045 | 11/1963 | Canada . |
| 757471 | 4/1967 | Canada . |
| 898191 | 4/1972 | Canada . |
| 926824 | 5/1973 | Canada . |

*Primary Examiner*—David A. Bucci
*Attorney, Agent, or Firm*—McFadden, Fincham

[57] ABSTRACT

There is disclosed a refuse system in which a conventional truck chassis includes a conventional garbage loading receptacle with a compaction device therein. The system provides additional compartments for reception of recyclable material. The compartments are individual modules and each include a lateral access opening and a lateral discharge opening with a device located within each for moving material located therein from one opening to the other.

6 Claims, 8 Drawing Sheets

REFUSE CARRIER FOR RECYCLABLE AND NON-RECYCLABLE MATERIAL

FIELD OF THE INVENTION

The present invention relates to refuse carriers and, more particularly, to a carrier having modules for both recyclable and non-recyclable materials.

BACKGROUND OF THE INVENTION

Refuse trucks have been known for many years. Conventionally, such trucks have included a compaction device located within the body to compact the material therein. Additionally, trucks incorporating fork lifting systems for lifting large refuse bins have been used for refuse management.

Exemplifications of typical refuse carriers and improvements therein are illustrated, for example, by U.S. Pat. No. 2,750,055. This document discloses a dump body which is pivotally mounted to a vehicle chassis. The body includes a compacting device therein to compact the material. Further, Canadian Patent No. 757,471 illustrates a refuse carrier which includes a high compression expelling piston for clearing the collecting area. Canadian Patent No. 530,976 discloses a spiral refuse system.

Other patent documents relating to various advancements in this art include Canadian Patent Nos. 926,824, 675,045 and 898,191.

Since the advent of environmental concerns, consumers have been encouraged to separate their refuse into recyclable and non-recyclable material.

Presently, cities and municipalities have had to collect the recyclable and non-recyclable material separately since the conventional trucks are not equipped to handle both types of this material. Such a limitation is illustrated in the prior art since no carrier discloses a provision for accommodating this need. Further, the need for refuse collecting companies to provide the present "two step" collection process is a costly and inconvenient practice.

Accordingly, there is a need for a refuse collection system in which both recyclable and non-recyclable refuse can be collected at the same time using a single carrier.

SUMMARY OF THE INVENTION

In the present invention, Applicant provides a refuse carrier employing compartments adapted to receive both types of refuse.

According to one object of the present invention, there is provided a refuse collecting vehicle having a body mounted to the chassis of the vehicle, the body including at least one opening therein and refuse compaction means therein, the improvement wherein:

the vehicle includes at least one separate compartment for receiving refuse, the at least one compartment having a lateral access opening for loading refuse therein and an opposed lateral discharge opening for discharging refuse therefrom; and displacement means in operative association with the at least one compartment for displacing refuse from the area of the access opening to the area of the discharge opening within the compartment.

Any number of separate and individual modular compartments may be included in the present invention to facilitate easy separation of glass, metal, paper and plastic, etc.

The body incorporated is similar to those illustrated in the art which includes an opening with compaction means located therein. These bodies are generally mounted to the chassis of a vehicle and include a compactor to compact the material therein.

In addition, the present invention includes lid opening means actuable by the compaction means during a discharge operation.

The means for moving the refuse laterally from one side of the compartment to the other includes suitable actuation means to effect this movement e.g. hydraulic cylinders etc. and facilitate compaction by advancing the material therein. Further, the cylinders may be adjusted to partially compress the recyclables.

The compartments are sufficiently large to store a substantial amount of recyclable refuse, or the compartments may have the material removed by accessing the compartment and actuating the means for moving the refuse.

According to another object of the present invention, the compartments may be loaded laterally from one side of the vehicle and discharged laterally from the opposite side thereof.

Further, the compartments for containment of recyclable refuse include lid opening means actuable by actuation means within the truck cab e.g. levers, switches, etc. (not shown).

According to yet another object of the present invention there is provided a refuse collecting vehicle comprising:

a vehicle having a chassis, and a body mounted to the chassis of the vehicle, the vehicle body having at least one opening and refuse compaction means therein, the vehicle further including at least one separate compartment adapted for receiving recyclable refuse, the at least one compartment with a chamber therein having a top, a bottom and spaced apart opposed sides, the compartment further including at least one lateral access opening for loading the recyclable refuse therein and at least one lateral discharge opening for discharging the recyclable refuse from the at least one separate compartment; and displacement means in operative association with the at least one compartment for moving the recyclable refuse from the access opening to the discharge opening within the compartment.

A still further object of the present invention, is to provide a vehicle body adapted for mounting on a vehicle chassis comprising:

a first refuse compartment connected to the chassis, the first compartment having at least one opening and refuse compaction means therein;

at least one separate second compartment adapted for receiving recyclable refuse, the at least one compartment having a top, a bottom and spaced apart opposed sides, the compartment further including at least one lateral access opening for loading the refuse therein and at least one lateral discharge opening for discharging the refuse from the second compartment; and means in operative association with the at least one second compartment for moving the refuse from the access opening to the discharge opening within the second compartment.

Having thus generally described the invention, reference will now be made to the accompanying drawings, illustrating preferred embodiments.

DETAILED DESCRIPTION OF THE PREFERRED EMBODIMENTS

Figure 1:
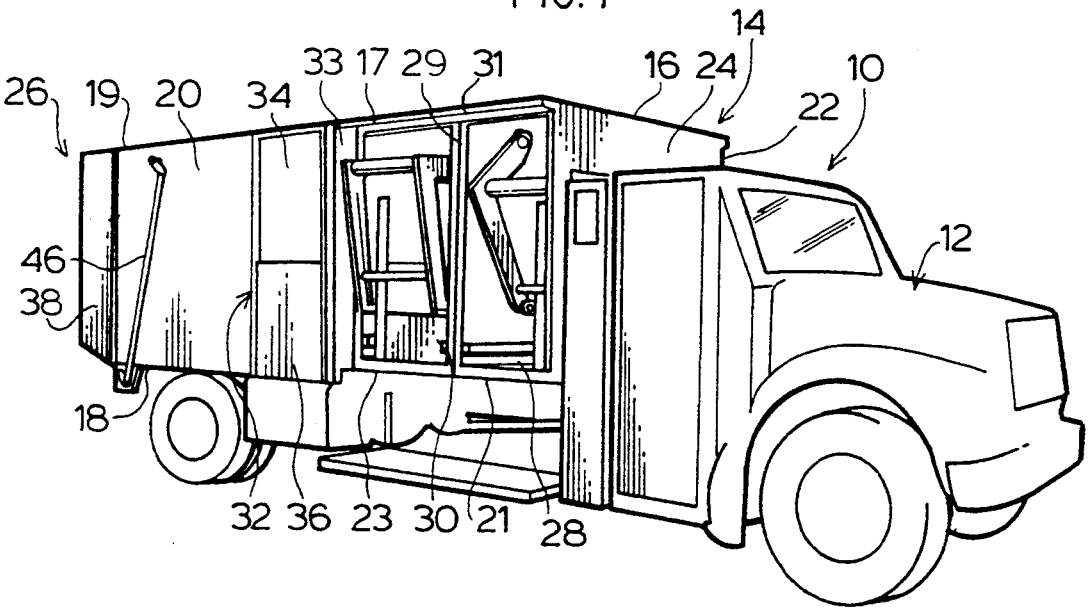
FIG. 1 is a right-hand perspective view of the carrier of the present invention.

Referring to FIG. 1, shown is a perspective right side view of the refuse collecting vehicle generally indicated by numeral 10. The vehicle comprises a conventional truck 12 with a cab and chassis (not shown). The overall truck body 14 generally includes a top 16, bottom 18, opposed sides 20 and 22 and front 24 and back 26. Typically, such truck body can be interchanged from one chassis to another or exchanged for differently sized bodies etc. These bodies are generally manufactured from suitable materials known to those in the art, for example, steel, aluminum etc. Further, it will be understood that, in the embodiments described hereinafter, the mechanisms of the invention will comprise suitable materials known to those skilled in the art, which are capable of withstanding substantial forces and extensive wear.

In greater detail of the present invention, the side 20 of body 14 preferably includes a plurality of juxtaposed modular compartments 28, 30 and 32 in which is placed refuse. The individual compartments combined on the same body enables municipalities etc. to collect both recyclable and non-recyclable material at the same time. Compartments 28 and 30 include, respectively, top walls 16 and 17, side walls 24, 29 and 31, 33 and bottom walls 21, 23. In the arrangement illustrated, compartment 32 is generally used to facilitate containment of non-recyclable material while compartments 28 and 30 are used for recyclable material e.g. paper, glass, metal, etc. Compartment 32 is generally defined by top wall 19, bottom wall 18 and spaced apart side walls 20, 22 and provides a lateral opening 34 into which the refuse may be placed within the compartment body. A door 36 is slidably mounted within guides (not shown) for vertical motion to an open position or closed position when the material within the compartment 32 is being compacted. The door 36 may be actuated by suitable means e.g. power drive means, winch means etc.

Figure 2:
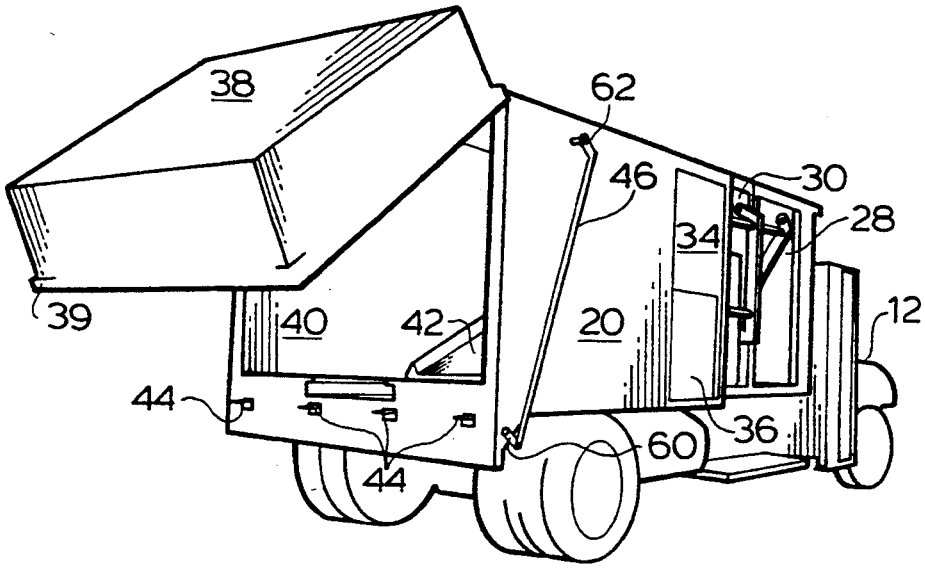
FIG. 2 is a rear perspective view of the carrier illustrated in FIG. 1.

FIG. 2, more clearly illustrates compartment 32. It is preferred that the compartment provide a door 38 pivotally connected adjacent the top 19 rearwardly of the body 14. The door 38 includes an outwardly extending lip 39 parallel to the plane thereof and about the periphery, and is actuated by power means (hereinafter described). The door 38, when pivoted upwardly, exposes a large opening 40 within the back 26 of the body 14. Once pivoted upwardly, the contents of the compartment 32 may be discharged from within the compartment to a more convenient location by making use of the compaction means 42 e.g. a ram or compressor plate. Such compaction means are known to those skilled in the art and generally are movable axially within the compartment along its length by known actuation means e.g. hydraulic or pneumatic cylinders. The door 38, when closed, as illustrated in FIG. 1, is engaged by latches 44, which cooperate with the door 38 to releasably engage the same. The latches 44 are generally operated by a translating member 46 hereinafter described. This is shown in greater detail in FIG. 3.

Figure 3:
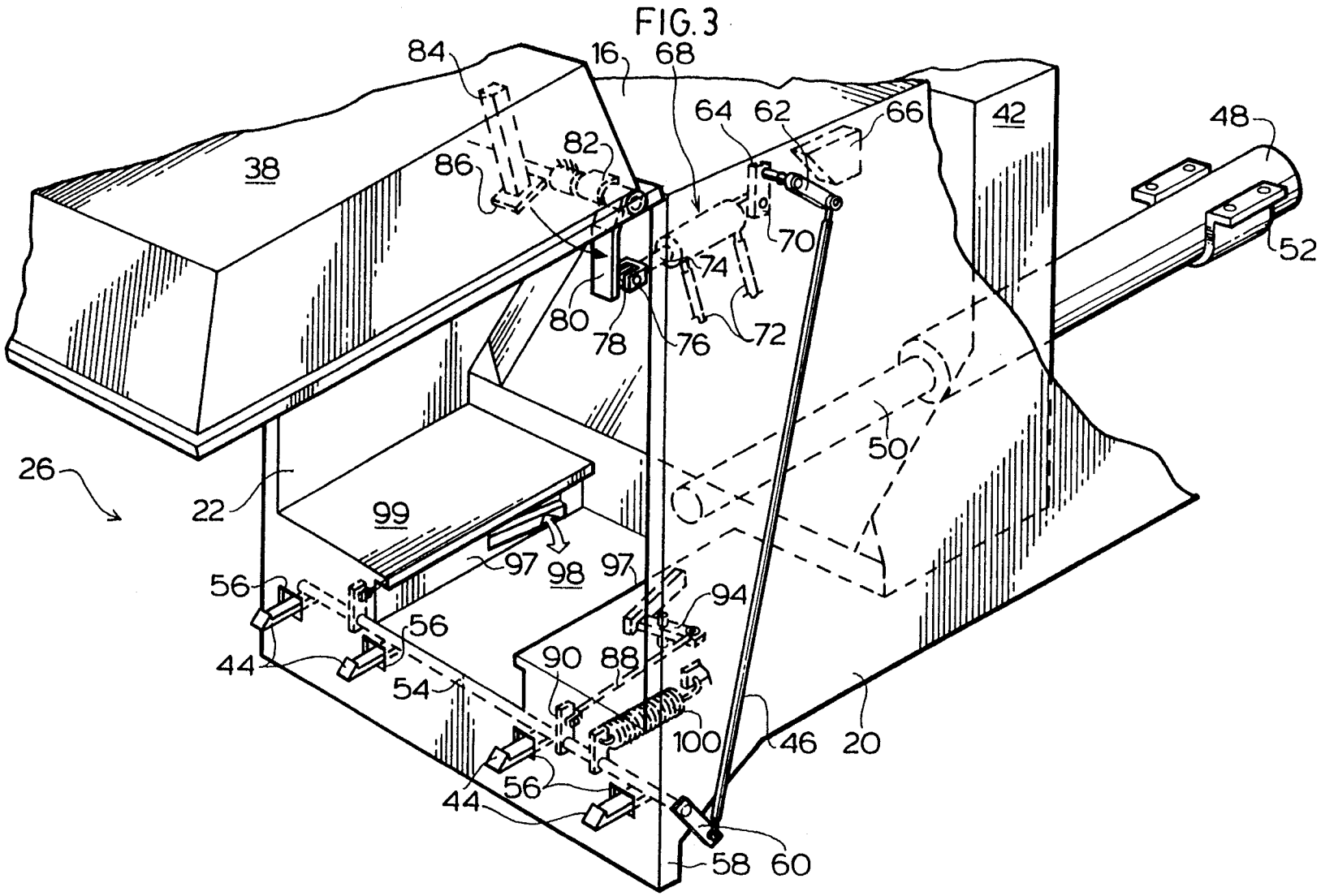
FIG. 3 is an enlarged partially cut-away view of the end of the carrier illustrated in FIG. 2.

Referring to FIG. 3, shown is an enlarged partially cut-away view of the rearward end 26 of the body 14, more clearly illustrating the mechanism for operation of the door 38 and compaction means 42. The compaction means 42 i.e. the ram preferably extends between the sides 20 and 22 of the body 14 for effective compaction of material therein and is sufficient in height to extend to the top 19 interior of the compartment 32. The ram 42 is, in one possible arrangement, actuable by a suitable cylinder 48 having a piston 50 movably mounted therein and in operative association with the ram 42. This assembly is contained within or under the chassis of the vehicle by a clamp 52. The cylinder 48 may be pneumatic, hydraulic etc. and operable by known means e.g. solenoid, fluid lines etc. The latches 44, briefly mentioned herein previously, comprise hook shaped members which are preferably spaced apart and connected along a common elongated member 54 by suitable means e.g. welding etc. The latches 44 project outwardly and generally perpendicularly from apertures 56 extending through a downwardly projecting vertical lip 58 of the back 26 of body 14.

The common elongated member 54 is preferably oriented in a parallel relationship with door 38 behind lip 58 of body 14. The elongated member 54 preferably extends through sides 20 and 22 of body 14 and, more particularly, compartment 32, at a rearward and lower point thereof. The outwardly extending sections of member 54 each are fixedly secured to a first linkage means 60 comprising a rod or bar of suitable rigid material which pivotally connects therewith a translating member 46 comprising an elongated length of rigid material which is spaced outwardly from the respective outside surface of sides 20 and 22. The translating members 46 preferably extend from the first linkage means 60, proximate the bottom of compartment 32, and diverge upwardly for pivotal connection at a second linkage means 62. The second linkage means 62, similar to the first, is a projecting segment of an intermediate linkage element 64 through body 14 of compartment 32. The intermediate linkage element 64 is connected to the second linkage means 62 at a point spaced inwardly from the back 26 of the compartment 32 adjacent the top 19 thereof. It is preferred that the intermediate linkage element 64 within the compartment 32 comprise a bar i.e. elongated rectangular length of sufficiently strong material and dimensioned to abut against stop means 66 hereinafter described.

The intermediate linkage means 64 communicates with a cylinder 68, e.g. hydraulic at a pivotal connection 70 spaced from the connection site of the second linkage means 64. Suitable fluid lines 72 provide the necessary fluid to operate the cylinder 68. The piston 74 of the cylinder 68 at the end thereof includes a conventional shaped connector 76 which receives an apertured tongue 78 of a door opening member 80 projecting downwardly from and associated with hinge member 82 of door 38. As is conventional, a connecting pin extends through the U-shaped connector 76 and apertured tongue 78 for interconnection of the same; cotter pins (not shown) may be associated with the ends of the pin to prevent disengagement. Abutment elements 84, each of which is mounted and located within the door 38 proximate the side thereof, include a contact surface 86 which registers in alignment for abutment against door opening member 80 of each side 20, 22 of the body 14. The operation of these components will be described hereinafter.

Referring back to elongated member 54, there is additionally included for each side of the compartment 32 linkage arms 88 each pivotally connected at one end thereof to connecting elements 90, which in turn are fixedly connected to the elongated member 54 of the underside of the body 14 of compartment 32. The other end of each of the linkage arms 88 are pivotally connected to L-shaped stop members 94 located and pivotally connected with housings 99, which pivot inwardly within the compartment 32 and more specifically, within chamber 98 between housings 99 of compartment 32. The stop members 94 pivot from a position flush with walls 97 of housings 99 to a position pivoted outwardly therefrom within chamber 98. This prevents the compaction means 42 from passing into chamber 98. This will be referred to hereinafter. Additionally, the elongated member 54 connects a spring 100 to the member 54 at each side beneath the compartment 32 which is connected to the L-shaped stop members 94.

Referring now to FIGS. 4 through 7, shown is a sequence of drawings illustrating cut-away views of the rear section of compartment 32 to illustrate the operation of the components.

Figure 4:
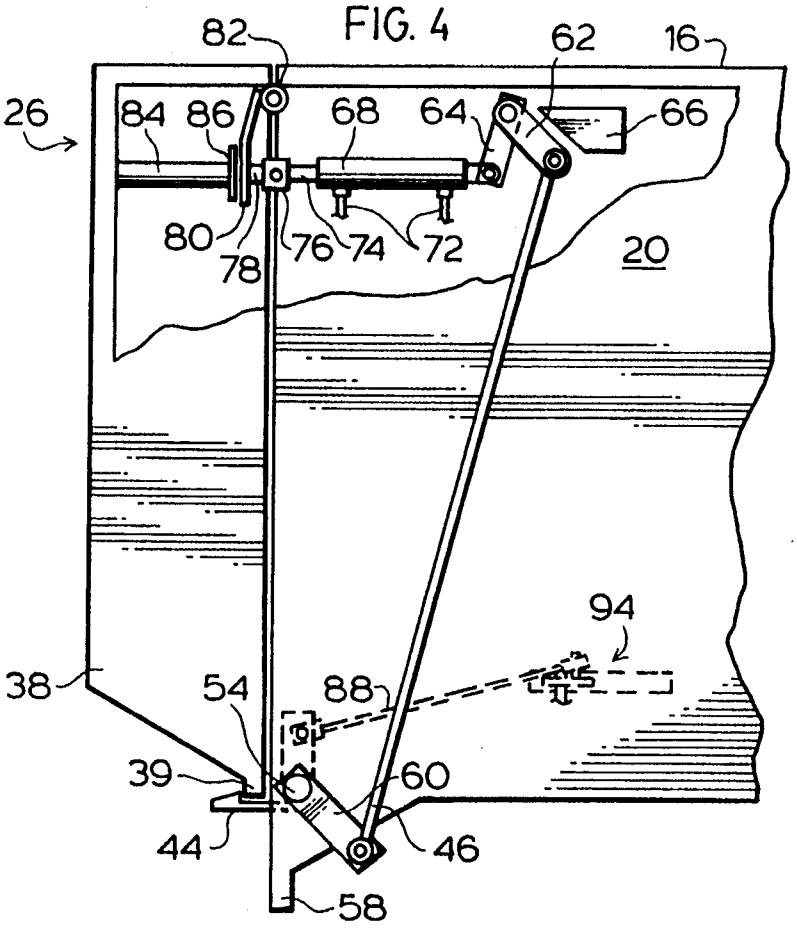
FIG. 4 is a partially cut-away side view of FIG. 3 during a first stage of operation.

FIG. 4 shows the position of the components when the lid 38 is in a closed and secured position. In this position, the hook shaped latches 44 engage and contact the lip 39 extending laterally about the periphery thereof and the first linkage means 60 is generally projecting downwardly from the connection point at elongated member 54. Similarly, second linkage means 62 is disposed in the same manner as the first linkage means, while the intermediate engaging member 64 within compartment 32 is disposed in an opposite attitude. The contact surface 86 of abutment member 84 is slightly spaced from contacting door opening member 80.

Figure 5:
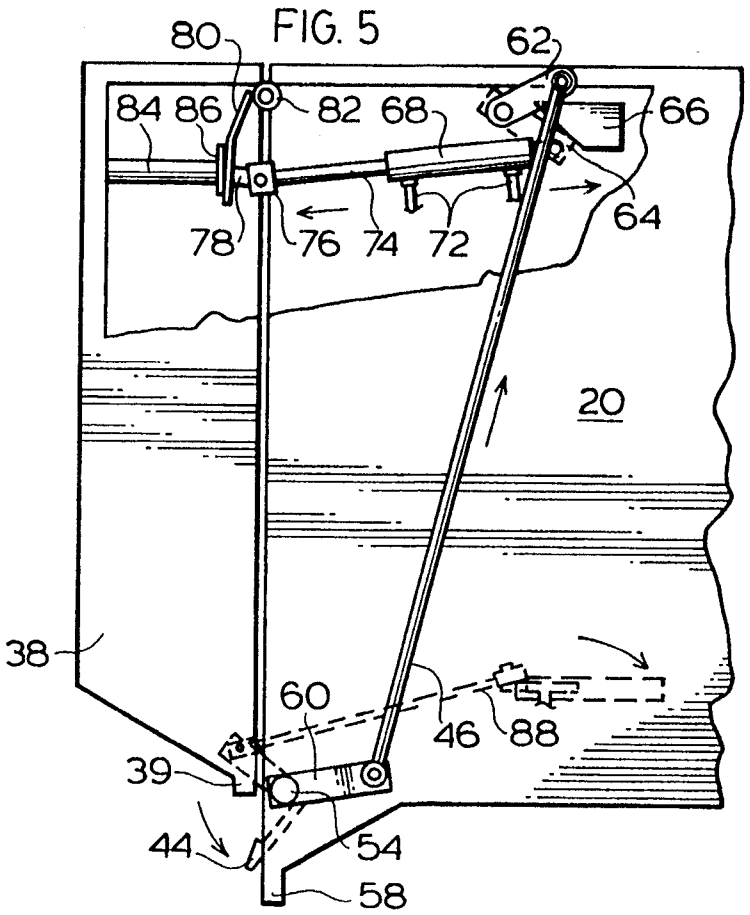
FIG. 5 is a partially cut-away side view of FIG. 3 during a second stage of operation.

FIG. 5 illustrates the disposition of the components when the door 38 begins to open. Generally, the piston 74 of cylinder 68 is urged outwardly toward stop means 66, which in turn, forces the door opening member 80 into engaging contact with contact surface 86 of abutment member 84. As this occurs, the cylinder, being pivotally connected to intermediate linkage 64, is forced rearwardly towards and urged against stop means 66. Additionally, since the second linkage means 62 is pivotally connected to the intermediate linkage 64, it is rotated upwardly which, in turn, imparts upward motion of translating member 46. The first linking means 60 is as previously discussed herein, pivotally connected to the translating member 46 and first linkage means 60. The elongated member 54 which is connected therewith rotates about a horizontal axis to thus disengage the latches 44 from engagement with the peripheral lip 39 of lid 38. Additionally, the L-shaped members 94 are retracted from a position within chamber 98 to a second position flush with walls 97. This is achieved by the motion translated by pivotally connected linkage arm 88 via connecting element 90 fixedly secured to member 54. Spring 100, also being connected to member 54 is stretched during this motion.

Figure 6:
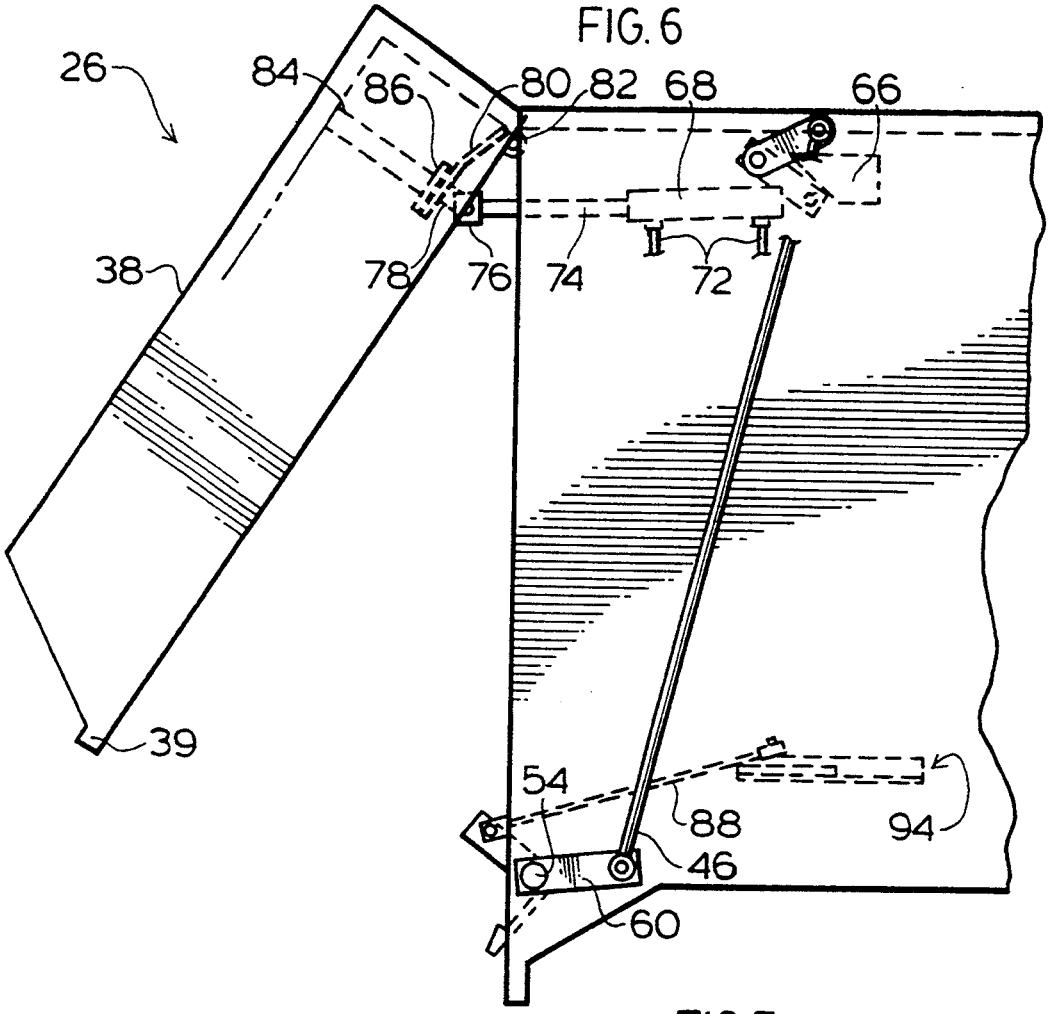
FIG. 6 is a partially cut-away side view of FIG. 3 during a third stage of operation.
Figure 7:
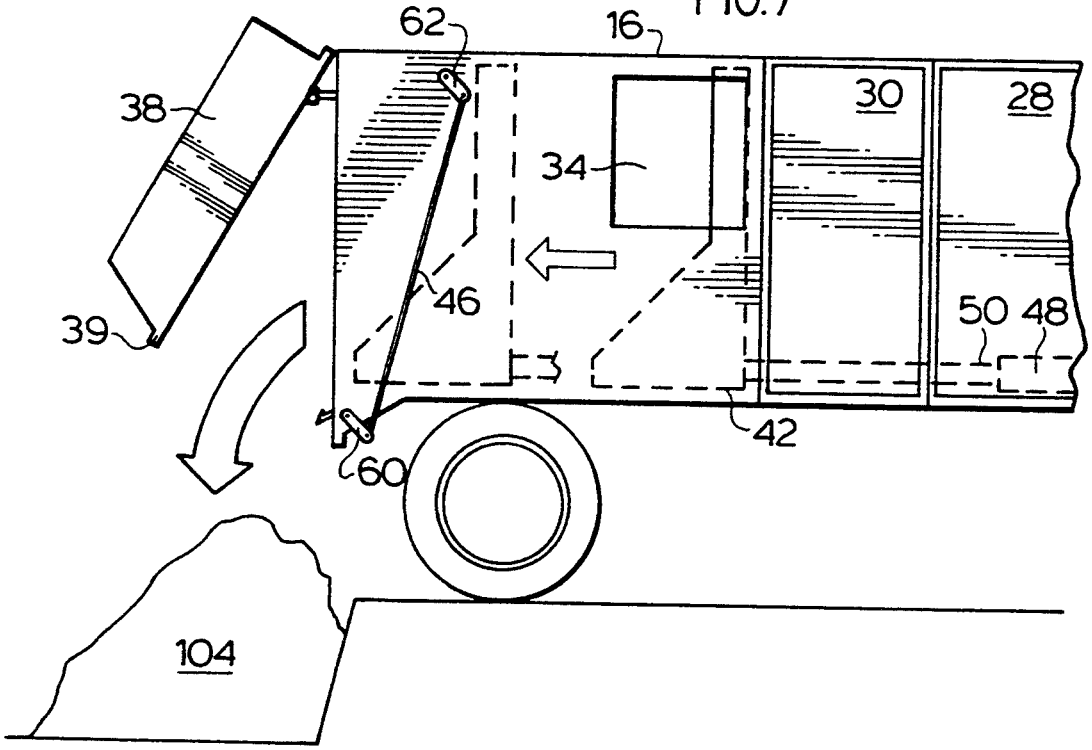
FIG. 7 is a partially cut-away side view of FIG. 3 during a fourth stage of operation.

Turning to FIG. 6, shown is a view of the rear section further in the opening sequence. This Figure illustrates the lid 38 in a position prior to discharge of the contents within compartment 32. The piston 74 of cylinder 68 is fully extended thus displacing the lid 38 outwardly. In addition, the L-shaped members 94 are retracted and flush with walls 97 to facilitate passage of compacting means 42 therethrough chamber 98, thus permitting discharge of the refuse material 104 as illustrated in FIG. 7. Once discharge is complete, spring 100 contracts to assist in returning the rear end 26 of the body 14 to the state illustrated in FIG. 4.

Figure 8:
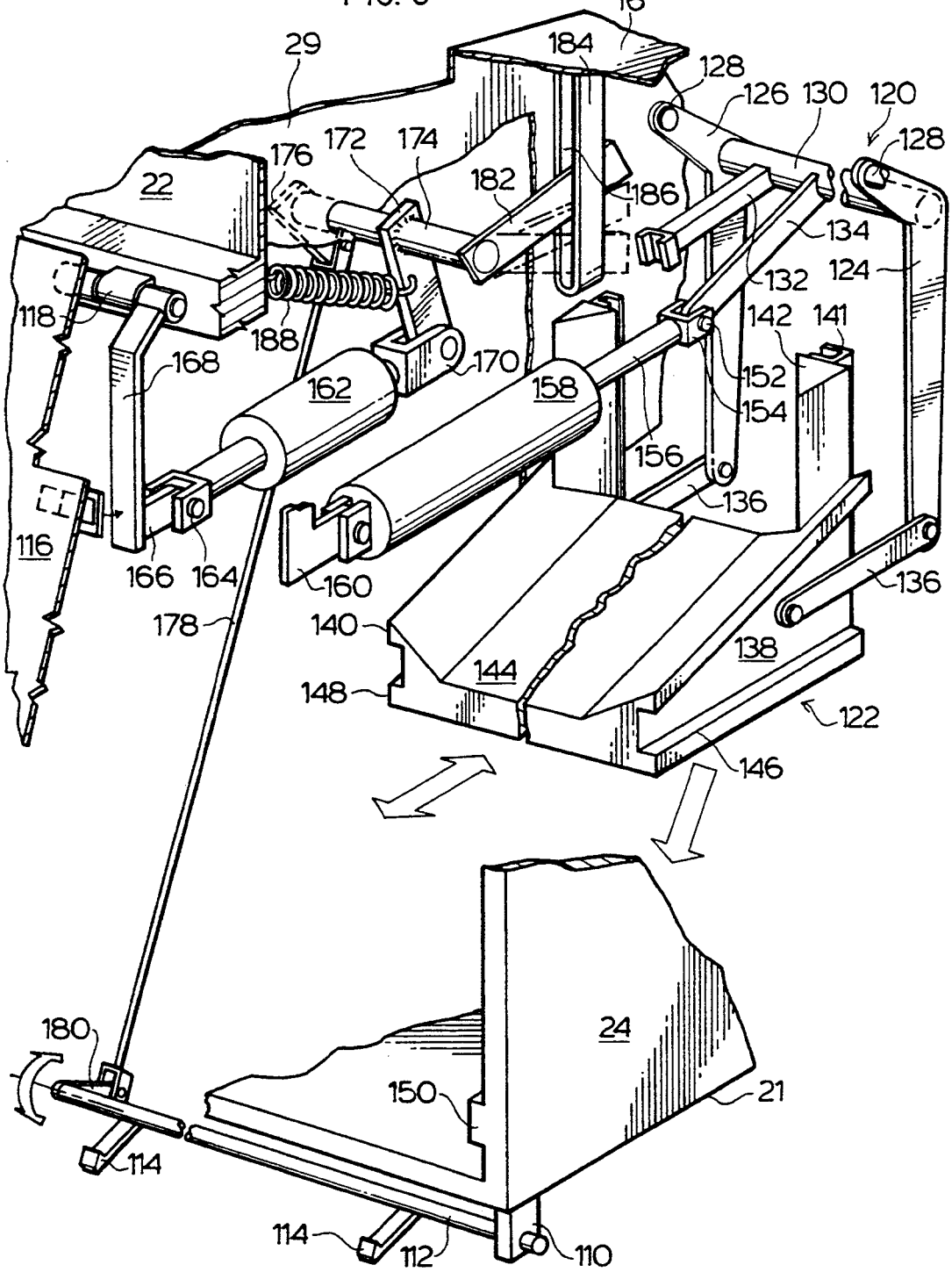
FIG. 8 is an enlarged partially cut-away view of the lateral compacting mechanism of the present invention.

Turning now to FIG. 8, shown is an enlarged cutaway view of the mechanism of the individual compartments 28 and 30 for the recyclable refuse. The compartment 28 includes a top wall 16, bottom wall 21 and spaced apart side walls 24 and 29. Compartment 30, in juxtaposition to component 28, includes top wall 17, opposed bottom wall 23 and spaced apart side walls 31 and 33. Both compartments include a similar mechanism and thus compartment 28 will be referred to in detail.

In the Figure, bottom wall 21 proximate the side edge thereof includes a pair of spaced apart downwardly projecting receiving members 110 (only one shown in the Figure), which receive an elongated member 112 similar to that disclosed herein previously for the end compartment 32. The elongated member 112 preferably has fixedly mounted thereon, in a spaced apart relationship, latches 114 which are adapted to releasably engage a door 116 which is pivotally and laterally mounted by hinges 118 adjacent top 16 of compartment 28 on side 22 thereof. This will be discussed in greater detail hereinafter.

Pivotally mounted within compartment 28 there is included an arm assembly 120 in operative association with the lateral compaction means 122. The assembly 120 includes a generally L-shaped arm having pins 128 which are suitably fastened within walls 24 and 29 for pivotal movement of the arms 124, 126. The arms are connected and maintained in the spaced apart relationship by a cross-member 130 fixedly secured by welding etc. adjacent pins 128. The cross-member 130 includes fixedly mounted thereon a perpendicularly oriented abutment arm 132 and spaced therefrom a piston linking arm 134 similarly perpendicularly oriented. These will be discussed hereinafter.

Referring to arms 124 and 126, it is preferred that each include, at a lower point thereof, a pivotally connected linkage arm 136 extending forwardly of the L-shaped pivoting arms 124 and 126. The generally straight arms 136 are, in turn, pivotally connected to opposed sides 138 and 140 of compaction means 122.

The compaction means 122 comprises a similar ram or compacting member as in the end compartment 32. The ram 122 includes a generally vertical back wall (omitted for clarity), which traverses the distance between the opposed walls 24 and 29 of the compartment 28 and a downwardly tapering base member 144 of equal width. The back wall 142 is received within the spaced apart channels 141 of the ram 122. It is preferred that the base member 144 include laterally disposed projections 146 and 148 associated with sides 138 and 140 thereof for suitable reception against mating guide channels 150, one of which is shown in the Figures. The guide channels 150 comprise projections integral and parallel with the planes of walls 24 and 29 and traversing the interior width thereof and spaced upwardly from the interior surface of bottom wall 21. These guide channels 150 when engaged with projections 146 and 148 aid in guiding the ram 122 when the ram is moving laterally within the compartment 28, and additionally prevent the interference of garbage with the motion of the ram 122.

As previously mentioned, cross-member 130 includes a fixedly secured piston linking arm 134. This arm comprises in one possible form, a bar which is apertured at one end to receive a coupling pin 152 when it is received within U-shaped connecting member 154 of piston 156. Cylinder 158 is the main cylinder for the lateral displacement of the ram 122. Piston 156 thus is movable within cylinder 158 by solenoid activation, hydraulic or pneumatic fluids. Piston 158 is preferably pivotally connected by a bracket 160 received within a U-shaped connecting element of cylinder 158. The bracket 160 may be mounted to the interior of top wall 16 of compartment 28. It is preferred that cylinder 158 is adjustable enabling partial or full compaction of the material within the compartments.

In addition to main cylinder 158, there is included a second cylinder 162 spaced from cylinder 158 within compartment 28 for operation of door 116. In a similar arrangement to the end compartment 32 in FIGS. 1 through 7, cylinder 162 preferably receives within a U-shaped connecting element 164 associated therewith, an apertured tongue 166 of a door opening member 168, which projects downwardly from, while being associated with door hinge 118. The other end of cylinder 162 includes a U-shaped connecting element 170 which, in turn, pivotally connects an intermediate linkage member 172. The opposed end of member 172 is preferably fixedly secured by, for example, welding to a pin 174 extending therethrough. The pin 174 extends through wall 29 and is mounted thereon for pivotal movement. A second linkage means 176 connected to an end of pin 174, extends outwardly from wall 29. This linkage means is similar to that of the second linkage means of the end compartment and includes a pivotally mounted translating member 178 which in turn is pivotally connected to a first linkage means 180 which is fixedly secured to elongated member 112. The other end of pin 174 includes a perpendicularly projecting finger 182 which is received within and preferably extends beyond the width of a hollow U-shaped downwardly projecting guide 184. The operation of these components will be described hereinafter. The finger 182 extends through guide 184 sufficiently to contact abutment arm 132 when compaction means 122 is brought in proximity therewith. In addition, linkage member 172 of pin 174 preferably includes a spring 188 connected therewith and to an inside surface spaced from the top 16 of compartment 28.

Reference will now be made to the operation of compartments 28 and 30 more clearly illustrated in FIGS. 9 through 12.

For clarity, the main cylinder 158 is removed from the drawings but it will be understood that this device effects the motion of the compaction means 112 during a stroke. Compartment 28 will be referred to for the operation sequence.

Figure 9:
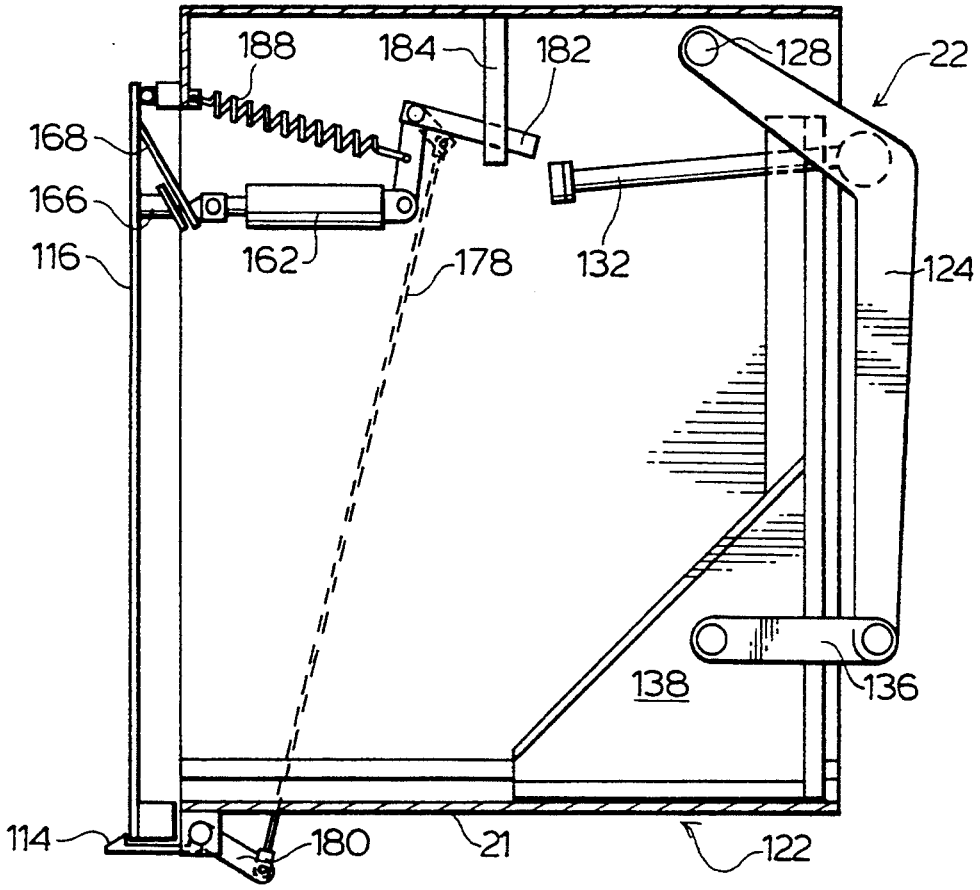
FIG. 9 is a partially cut-away side view of FIG. 8 during a first stage of operation.
Figure 10:
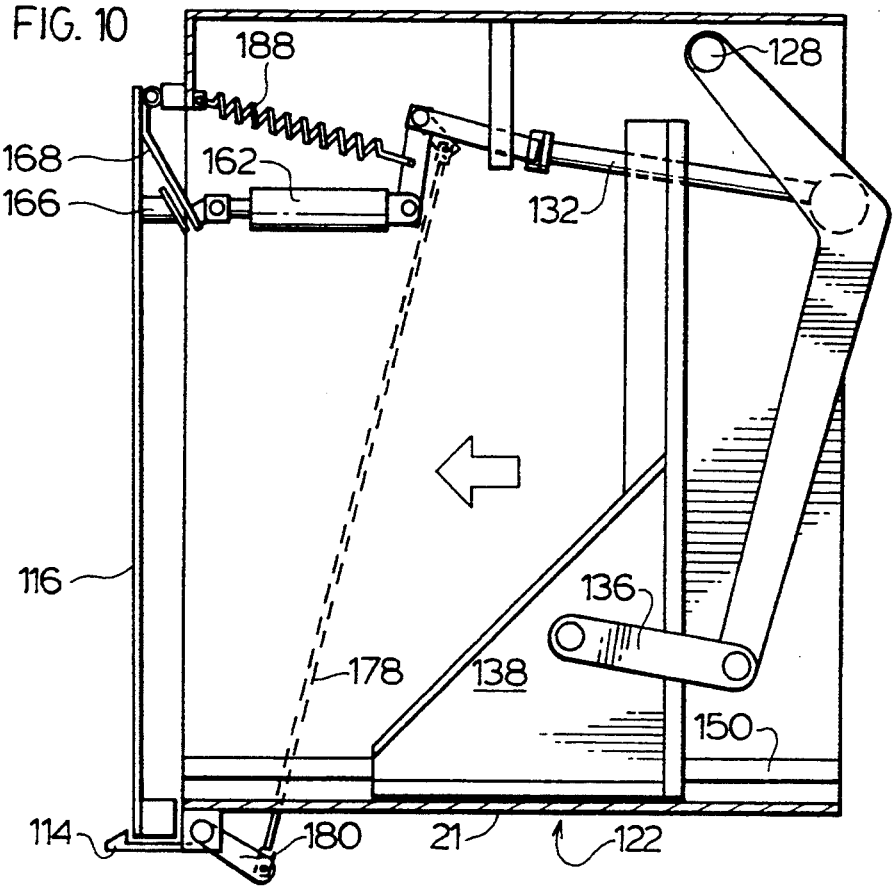
FIG. 10 is a partially cut-away side view of FIG. 8 during a second stage of operation.

FIG. 9 illustrates a side view of FIG. 8. This Figure generally illustrates the positions of the components during a loading procedure. Recyclable material is placed within the lateral opening of side 22 of compartment 28 for retention therein. As material is collected therein, the material may require compaction. During this operation, compaction means 122 moves laterally within compartment 28 from right to left under the pulling force of main cylinder 158.

Figure 11:
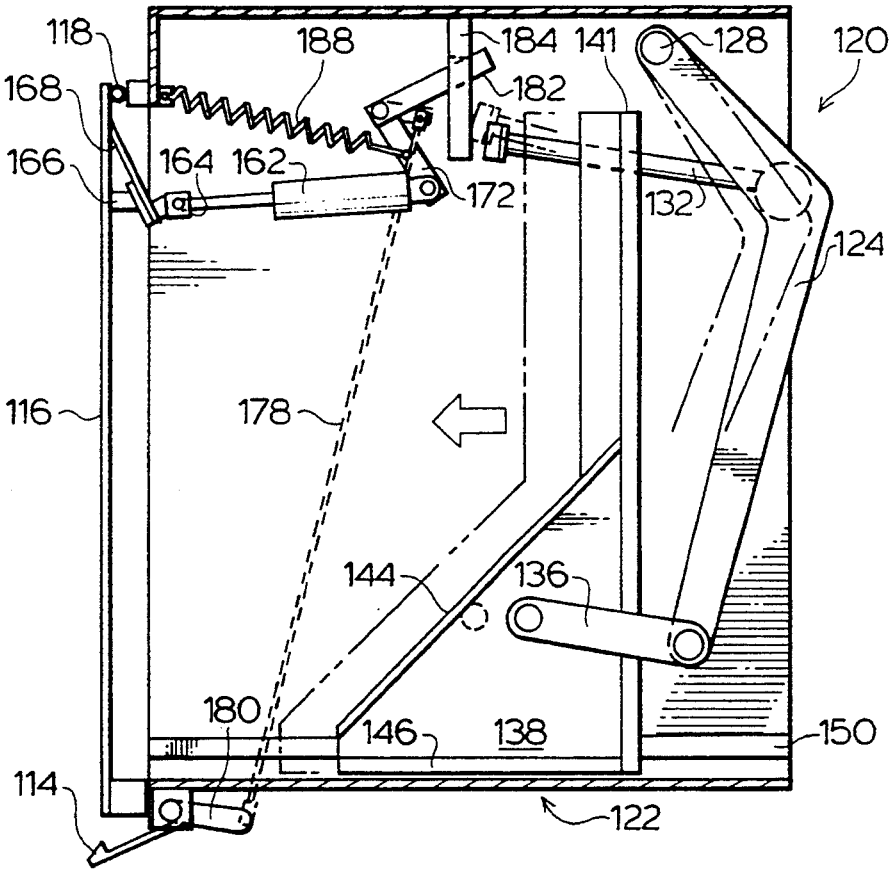
FIG. 11 is a partially cut-away side view of FIG. 8 during a third stage of operation.

The pivoting arms 124 and 126 move during this motion from a generally straight attitude to an inclined attitude by pivoting about pins 128 associated therewith. Additionally, linkage arms 136 move from a generally straight attitude to an angularly inclined attitude as compaction means 122 moves within guide channels 150. The compaction stroke can be appreciated by a comparison of FIGS. 9 and 10. This operation is initiated by use of conventional switches, levers, etc. located within the cap. At a full compaction stroke, as illustrated in FIG. 11, abutment arm 132 is disengaged from contacting finger 182, which is associated with the operation of door 116. Continued lateral movement of the compaction means 122 effects a sequence of operations of the components associated with the door 116. This is more clearly illustrated in FIG. 11. At this point, abutment arm 132 and forced finger 182 within the U-shaped guide are out of contact; this results in the rotation of pin 174 about a horizontal axis which, in turn, rotates linkage member 172 fixedly secured thereon. A further result of this motion causes cylinder 162 to move laterally and away from door 116. Spring 188, being connected between linkage element 172 and the internal wall 22 stretches and causes the piston of cylinder 162 to move outwardly therefrom.

Translating member 178 being in contact with pin 174 via second linkage means 176 effects the translated motion to the first linkage means 180 which, in turn, effects the rotation of elongated member 112 to release latches 114 from engagement with door 116.

Figure 12:
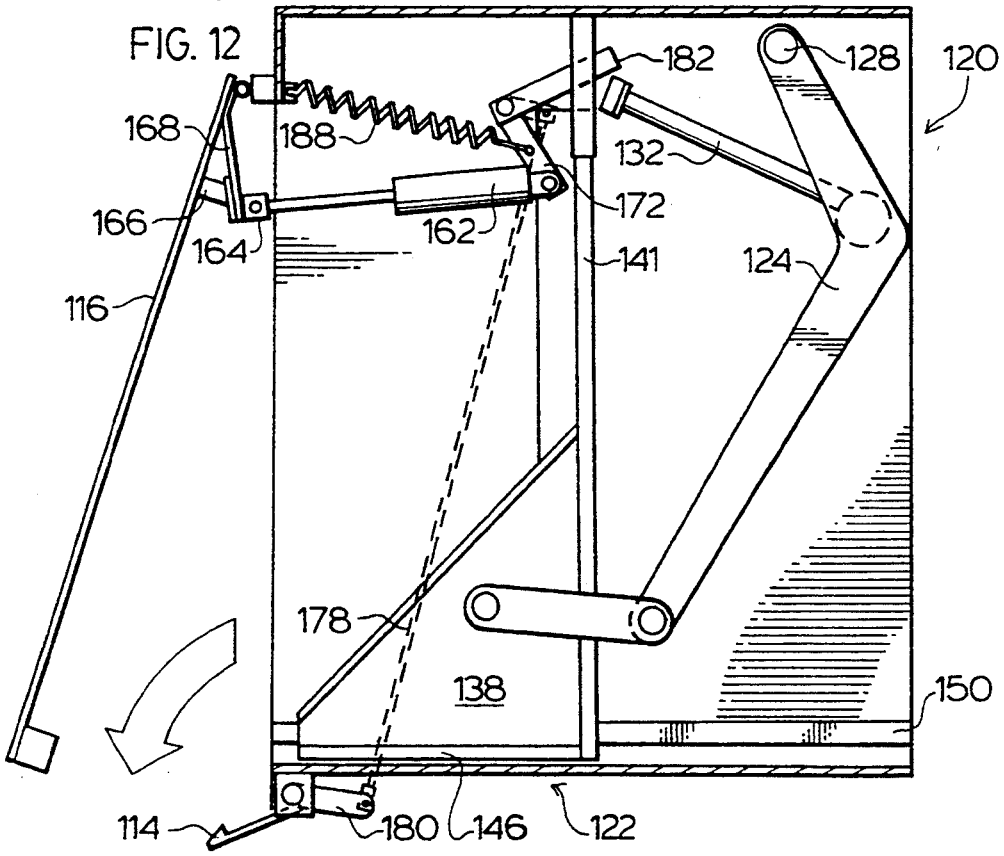
FIG. 12 is a partially cut-away side view of FIG. 8 during a fourth stage of operation.

Finally, once compaction means 122 is fully laterally displaced, i.e. on the left-hand side of the compartment, the piston of cylinder 162 is urged outwardly further thus causing the door 116 to pivot outwardly and laterally from the body 14 for the discharge of the recyclable material from compartment 28 as illustrated in FIG. 12.

Figure 13:
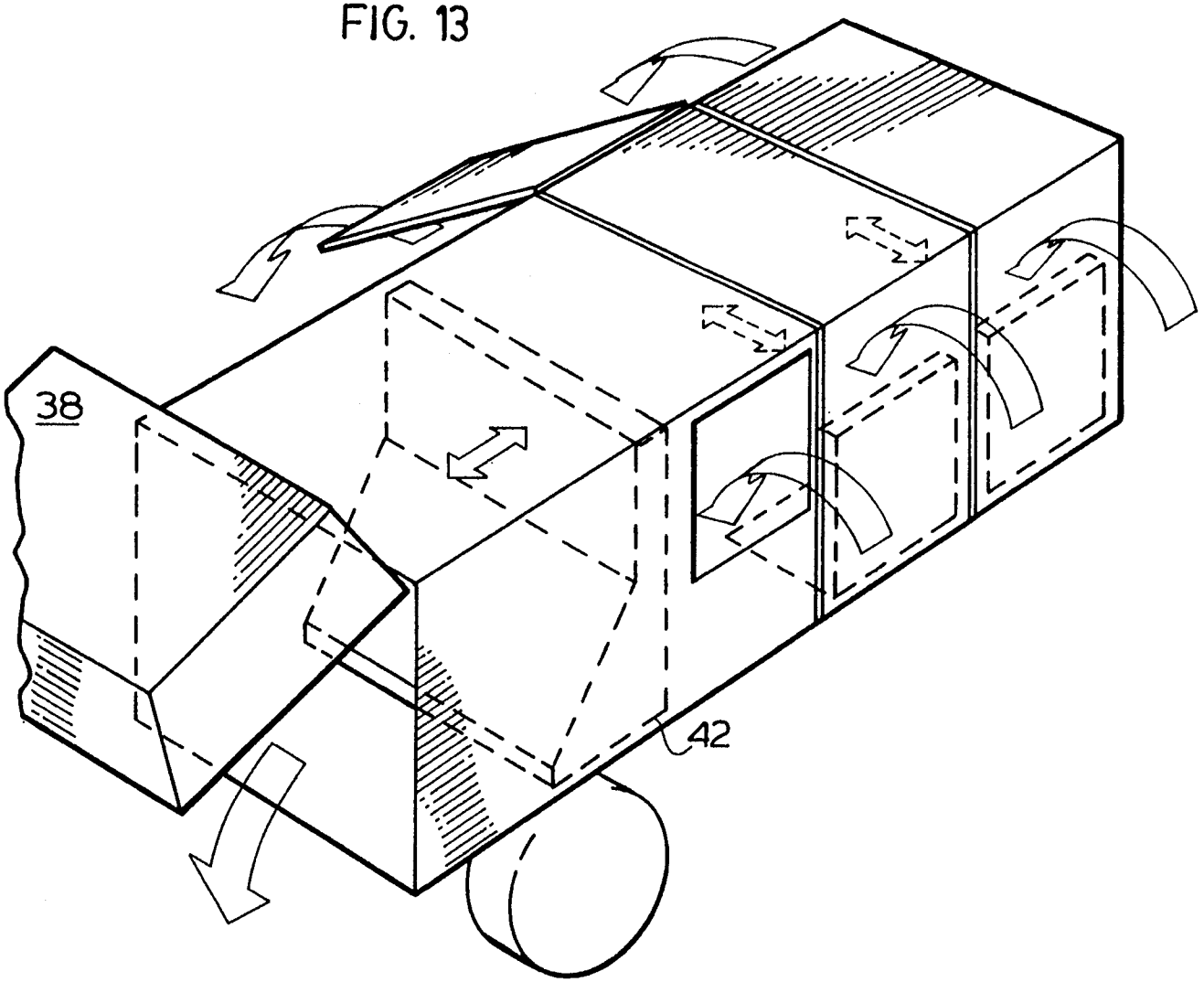
FIG. 13 is a rear perspective view of the truck body having parts removed therefrom.

Referring to FIG. 13, shown is a perspective rear view of the body 14 with a majority of the parts removed. The Figure illustrates the rams (dotted lines) in their respective compartments as well as the direction of motion of each as indicated by the arrows in the drawing.

Although specific embodiments of the present invention have been described above, it is not limited thereto and it will be apparent to those skilled in the art that numerous modifications form part of the present invention insofar as they do not depart from the spirit, nature and scope for the claimed and described invention.

I claim:

1. A refuse collecting vehicle comprising:

a vehicle having a chassis, and a body mounted to said chassis of said vehicle, said body having a first compartment having a door assembly, an opening and refuse compaction means therein, said vehicle further including at least one separate compartment adapted for receiving recyclable refuse, said at least one separate compartment with a chamber therein having a top, a bottom and spaced apart opposed sides, said separate compartment further including at least one lateral access opening for loading said recyclable refuse therein and at least one lateral discharge opening for discharging said recyclable refuse from said at least one separate compartment;

a movable compaction means in said at least one separate compartment, and movable between said lateral access opening and said lateral discharge opening, said movable compaction means being adapted to effect discharge of compacted refuse from said body;

and said vehicle further including stop means having a pair of opposed stop members actuable between an opened position whereby said stop members are effective to limit the movement of said compaction means and a closed position whereby said stop members do not limit the movement of said compaction means whereby said compaction means may be actuated to effect discharge of compacted refuse from said body; and actuation means for effecting sequential actuation of said stop members and said body further includes latch members and means for effecting movement of said door assembly, said actuation means comprising means linking said means for effecting movement of said door assembly, said stop members, and said latch members whereby displacement of said actuation means from a first position to a second position is effective to disengage said latch members from said door assembly and is effective to move said stop members from an opened position to a closed position and is effective to actuate said means for effecting movement of said door assembly from a closed position to an opened position.

2. The refuse collecting vehicle as defined in claim 1, wherein said body includes a movable door assembly movable between a first closed position and a second opened position whereby refuse may be discharged from said body.

3. The refuse collecting vehicle as defined in claim 1, wherein said body includes means for biasing said actuation means into a first position whereby said door assembly is in a closed position, said latch members engage said door assembly and said stop means are in an opened position.

4. The refuse collecting vehicle as defined in claim 1, wherein said movable compaction means includes a movable base and wall assembly movable between said access opening and said discharge opening, said movable base and wall assembly being adapted to receive refuse loaded from said access opening and for advancement of refuse in said compartment to said discharge opening.

5. The refuse collecting vehicle as defined in claim 4, wherein said vehicle includes means for advancing said base and wall assembly, said advancing means including a piston assembly, a pivotal arm assembly actuable by said piston assembly, said pivotal arm assembly being pivotally mounted at a first point above said base and wall assembly and about a fixed axis, and pivotally connected to said base and wall assembly at a second point spaced from said first point.

6. The refuse collecting vehicle as defined in claim 1, wherein said discharge opening includes a movable discharge door movable between a first closed position and a second opened position whereby when it is desired to discharge refuse from said compartment, said movable discharge door permits free discharge of refuse from said compartment.

* * * * *